US010808442B2

(12) United States Patent
Salice

(10) Patent No.: US 10,808,442 B2
(45) Date of Patent: Oct. 20, 2020

(54) DECELERATED HINGE FOR PIECES OF FURNITURE

(71) Applicant: ARTURO SALICE S.P.A., Novedrate (IT)

(72) Inventor: Luciano Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 0 days.

(21) Appl. No.: 15/538,909

(22) PCT Filed: Dec. 11, 2015

(86) PCT No.: PCT/EP2015/079471
§ 371 (c)(1),
(2) Date: Jun. 22, 2017

(87) PCT Pub. No.: WO2016/102215
PCT Pub. Date: Jun. 30, 2016

(65) Prior Publication Data

US 2017/0350179 A1 Dec. 7, 2017

(30) Foreign Application Priority Data

Dec. 23, 2014 (IT) ..... MI2014A002226

(51) Int. Cl.
*E05F 5/02* (2006.01)
*E05F 5/00* (2017.01)
*E05F 3/20* (2006.01)

(52) U.S. Cl.
CPC ..... *E05F 5/006* (2013.01); *E05F 3/20* (2013.01); *E05F 5/02* (2013.01); *E05Y 2201/21* (2013.01);
(Continued)

(58) Field of Classification Search
CPC ..... E05F 3/20; E05F 5/02; E05F 5/006
See application file for complete search history.

(56) References Cited

U.S. PATENT DOCUMENTS 5,269,043 A * 12/1993 Yang ..... E05F 5/006 16/68
8,424,161 B2 * 4/2013 Sutterlutti ..... E05F 5/006 16/286
(Continued)

FOREIGN PATENT DOCUMENTS

CN 102325954 A 1/2012
EP 1359275 A2 11/2003
(Continued)

OTHER PUBLICATIONS

International Search Report and Written Opinion dated Feb. 24, 2016 issued in PCT/EP2015/079471.
(Continued)

*Primary Examiner* — Emily M Morgan
(74) *Attorney, Agent, or Firm* — Scully, Scott, Murphy & Presser, P.C.

(57) ABSTRACT

A decelerated hinge for pieces of furniture, including a fixed part which can be connected to the body of a piece of furniture and a moveable part, which is constituted by a box with side walls and a bottom and can be connected to a leaf of the piece of furniture, a deceleration device which includes at least one linear decelerator and actuation elements for the linear decelerator; the at least one linear decelerator and the actuation elements being accommodated in an accommodation body which can be coupled to the side walls and the bottom of the hinge box.

16 Claims, 4 Drawing Sheets

(52) U.S. Cl.
CPC ... *E05Y 2201/256* (2013.01); *E05Y 2201/264* (2013.01); *E05Y 2600/46* (2013.01); *E05Y 2900/20* (2013.01)

(56) References Cited

U.S. PATENT DOCUMENTS

| | | | | |
|---|---|---|---|---|
| 8,650,711 | B1 | 2/2014 | Chen et al. | |
| 2004/0103499 | A1* | 6/2004 | Egger | E05D 11/087 16/242 |
| 2007/0136990 | A1* | 6/2007 | Salice | E05D 5/08 16/282 |
| 2008/0109987 | A1* | 5/2008 | Chen | E05F 5/006 16/68 |
| 2008/0276426 | A1* | 11/2008 | Salice | E05D 11/1021 16/333 |
| 2009/0049645 | A1* | 2/2009 | Salice | E05D 11/1021 16/250 |
| 2010/0205775 | A1* | 8/2010 | Salice | E05D 11/087 16/337 |
| 2011/0298349 | A1* | 12/2011 | Sutterlutti | E05F 5/006 312/326 |
| 2013/0160242 | A1 | 6/2013 | Brunnmayr | |
| 2014/0165333 | A1* | 6/2014 | Brunnmayr | E05F 5/006 16/319 |
| 2014/0331451 | A1* | 11/2014 | Holzapfel | E05F 5/006 16/286 |
| 2014/0366322 | A1* | 12/2014 | Salice | E05F 5/006 16/277 |
| 2016/0010380 | A1* | 1/2016 | Svara | E05F 5/006 49/386 |
| 2017/0081890 | A1* | 3/2017 | Buschmann | E05F 1/14 |

FOREIGN PATENT DOCUMENTS

| | | | | |
|---|---|---|---|---|
| EP | 1809843 | B1 | 2/2008 | |
| JP | 2008-519922 | A | 6/2008 | |
| JP | 2009-536700 | A | 10/2009 | |
| JP | 2012-521500 | A | 9/2012 | |
| JP | 2013-536337 | A | 9/2013 | |
| WO | WO 2010/108203 | A1 | 9/2010 | |
| WO | WO 2012/024711 | A1 | 3/2012 | |
| WO | WO-2017182238 | A1 * | 10/2017 | E05F 5/006 |

OTHER PUBLICATIONS

Italian Search Report and Written Opinion dated Aug. 31, 2015 issued in IT MI20142226, with partial translation.

Taiwanese Office Action dated Apr. 17, 2019 received in Taiwanese Application No. 10820344540.

Japanese Office Action dated Dec. 3, 2019 received in Japanese Patent Application No. 2017-534718, together with an English-language translation.

* cited by examiner

DECELERATED HINGE FOR PIECES OF FURNITURE

The present invention relates to a decelerated hinge for pieces of furniture. More specifically, the invention relates to a decelerated hinge for pieces of furniture which offers characteristics of simplified assemblability.

As is known, in the furniture sector, in order to support in an oscillating manner the door leaves of pieces of furniture, conventionally use is made of hinges that comprise a fixed part which can be connected to the body of the piece of furniture and a moveable part, constituted by a box, which can be connected to the door leaf of the same piece of furniture, such parts being mutually articulated in an oscillating manner directly by way of a rotation axis or by way of a system of articulation that comprises connecting rockers.

In order to maintain the door leaf in the closed position, the hinges likewise comprise adapted elastic means, which can for example comprise a V-shaped leaf spring which is loaded to push the arm of the fixed part, or the system of articulation, in the direction of closure of the hinge.

However, owing to the presence of such elastic means, the door leaf, in the closed position, slams against the body of the piece of furniture with force, causing unwanted noise.

In order to overcome such problem, it has been proposed to adopt a deceleration device arranged inside, or associated with, one of the parts of the hinge in order to dampen the closure movement of the hinge.

The deceleration device can be of the linear type or of the rotating type, and it can use a fluid or a grease as braking means. In the latter case, however, it has been found that a grease is usually more sensitive to variations of temperature and as a consequence it offers less constant performance.

In order to make the deceleration device invisible without making changes to the external appearance of the hinge, various solutions have been proposed, one of which involves a deceleration device of the fluid-operated linear type arranged on an outer side of the side walls of the box, so as to be flush with the box within the thickness of the door leaf when the hinge is mounted on the piece of furniture. Such device is disclosed in WO2010/108203.

Specifically, such conventional device comprises a body for accommodating at least one fluid-operated deceleration cylinder, within which a piston is axially and moveably arranged and is provided with a rod protruding from the cylinder.

For the purposes of actuation of the deceleration device, during the movement to close the door leaf, the fixed part of the hinge or one of the rockers of the articulation system of the hinge comes into contact with a separate actuation element which is supported so that it can oscillate about an axis arranged inside the box of the hinge, and such actuation element is functionally connected to the rod of the piston by way of a transmission mechanism, which converts the rotary motion of the actuation element to a linear movement of the piston of the deceleration device.

Such transmission mechanism, in addition to exhibiting a high level of complexity of construction owing to the presence of several reduced-size components, also entails problems with assembly, in that the oscillating actuation element, once the body of the deceleration device has been applied to the box of the hinge, must be functionally connected to the components of the transmission mechanism, by way of additional assembly operations that are decidedly complex.

Finally, a deceleration device of the grease-operated rotary type is disclosed in EP1809843, which is in the form of an assembly that can be mounted on an outer side of the side and bottom walls of the box of the hinge. Such device has a deceleration disk which is actuatable by way of a slider and a cam which is integral with one of the rockers of the hinge.

The aim of the present invention is to provide a decelerated hinge for door leaves of furniture or the like, which has a deceleration device of the fluid-operated linear type which is configured to provide an efficacious decelerating action and is simple to assemble together with the hinge.

Within this aim, an object of the present invention is to provide a decelerated hinge for door leaves of pieces of furniture or the like, in which the decelerating effect has a constant performance as the environmental conditions and conditions of use vary.

Another object of the present invention is to provide a decelerated hinge for door leaves of pieces of furniture or the like which is highly reliable, easily and practically implemented and low cost.

This aim and these and other objects which will become better apparent hereinafter are achieved by a decelerated hinge for pieces of furniture, comprising a fixed part which can be connected to the body of a piece of furniture and a moveable part, which is constituted by a box with side walls and a bottom and can be connected to a leaf of the piece of furniture, said fixed part and said moveable part being mutually articulated in an oscillating manner, there being further a deceleration device which comprises at least one linear decelerator and actuation means for said linear decelerator, characterized in that said at least one linear decelerator can be coupled to said actuation means in the condition in which the deceleration device is disassembled from said hinge, said at least one linear decelerator and said actuation means being accommodated in an accommodation body which can be coupled externally to the side walls and the bottom of said hinge box.

Further characteristics and advantages of the invention will become better apparent from the description of a preferred, but not exclusive, embodiment of the hinge according to the present invention, which is illustrated by way of non-limiting example in the accompanying drawings wherein.

Figure 1:
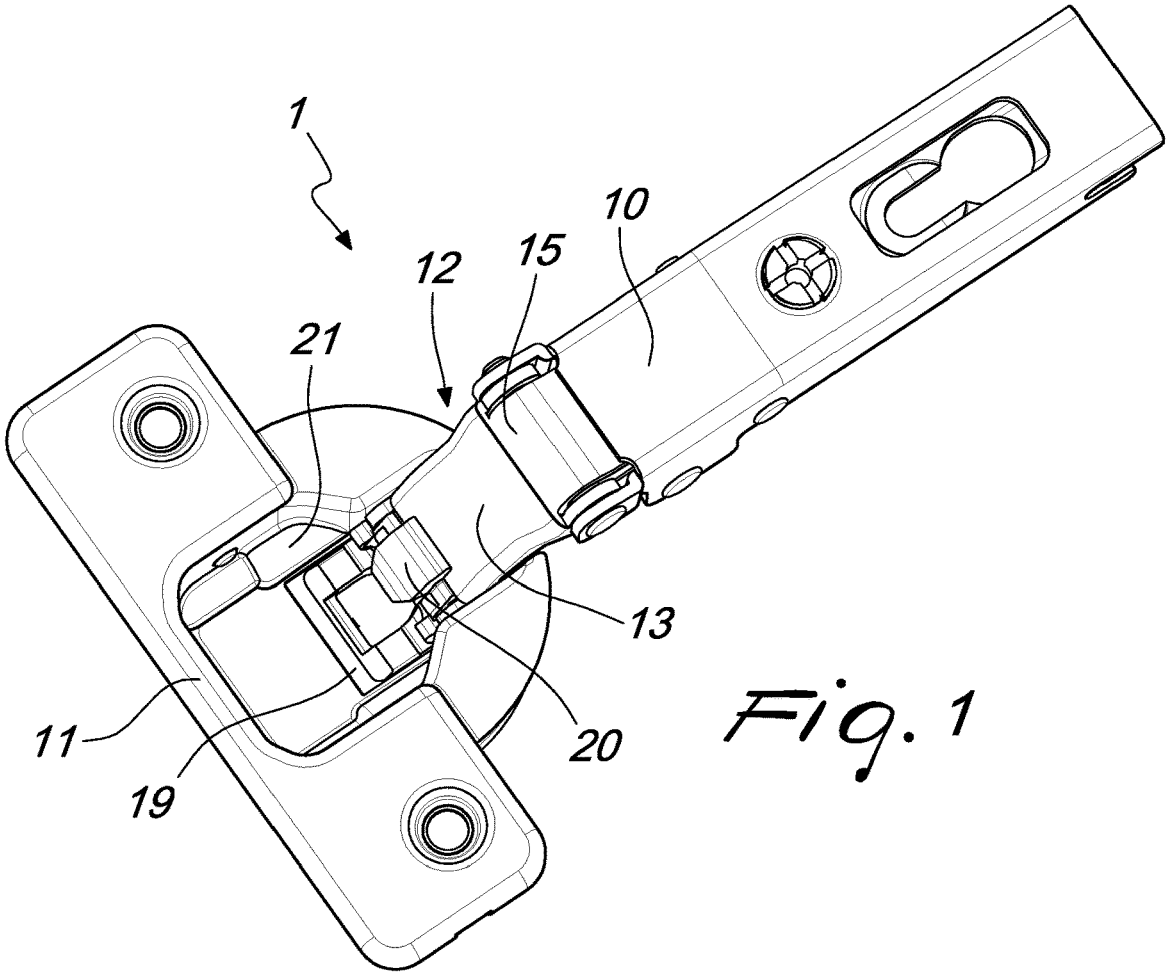
FIG. 1 is a perspective view from the front of a hinge according to the invention.
Figure 2:
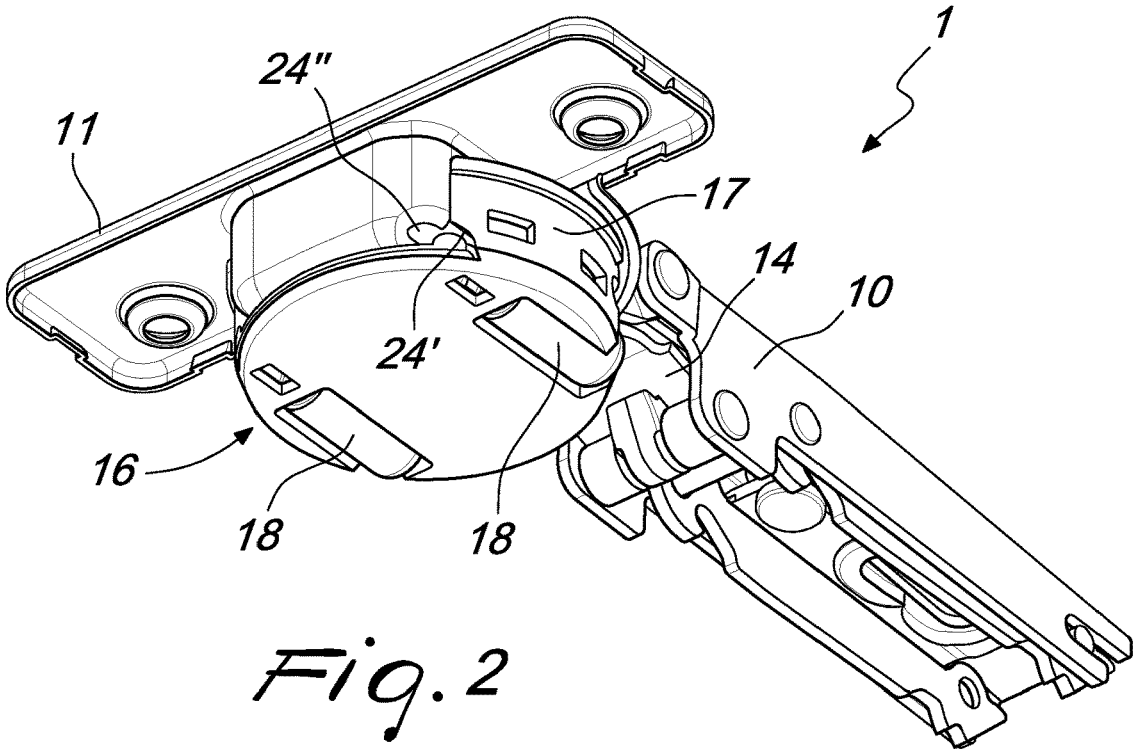
FIG. 2 is a perspective view from the rear of the hinge according to the invention.
Figure 3:
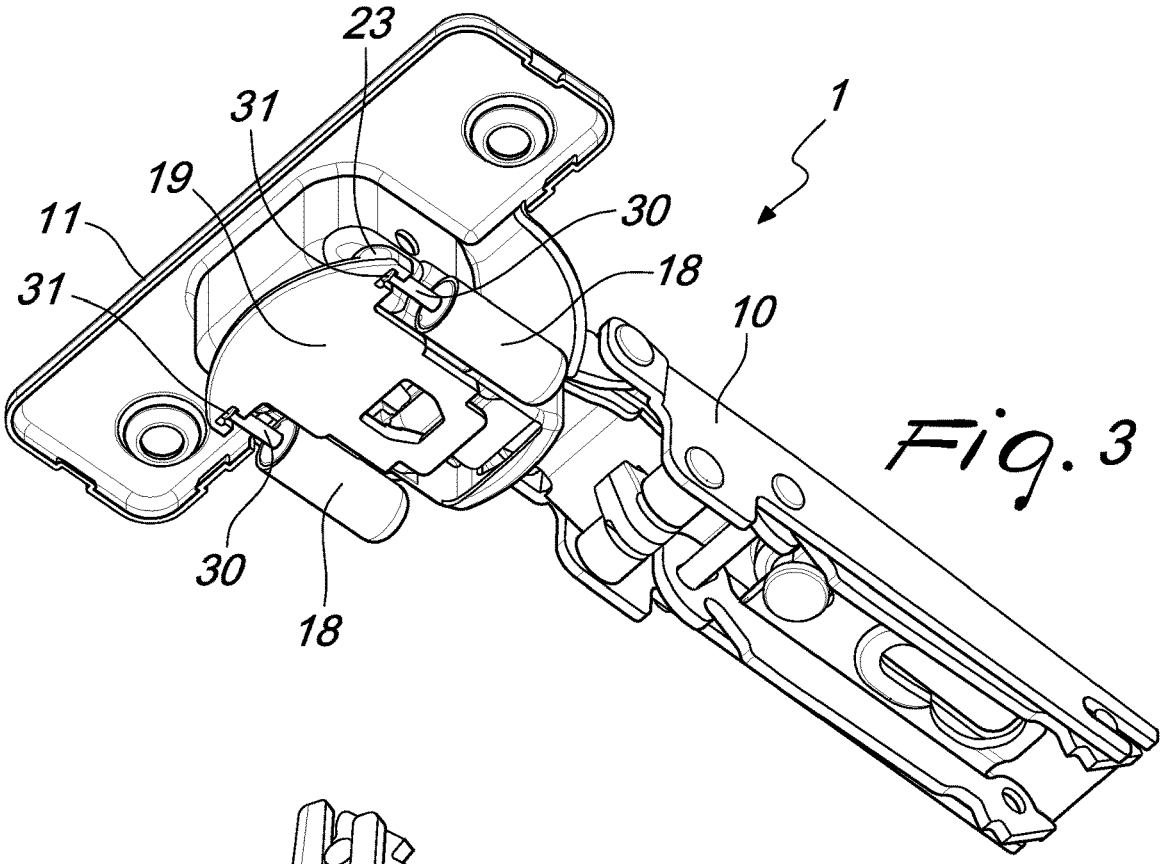
FIG. 3 is a view of the hinge in FIG. 2 with the body of the decelerator removed.
Figure 4:
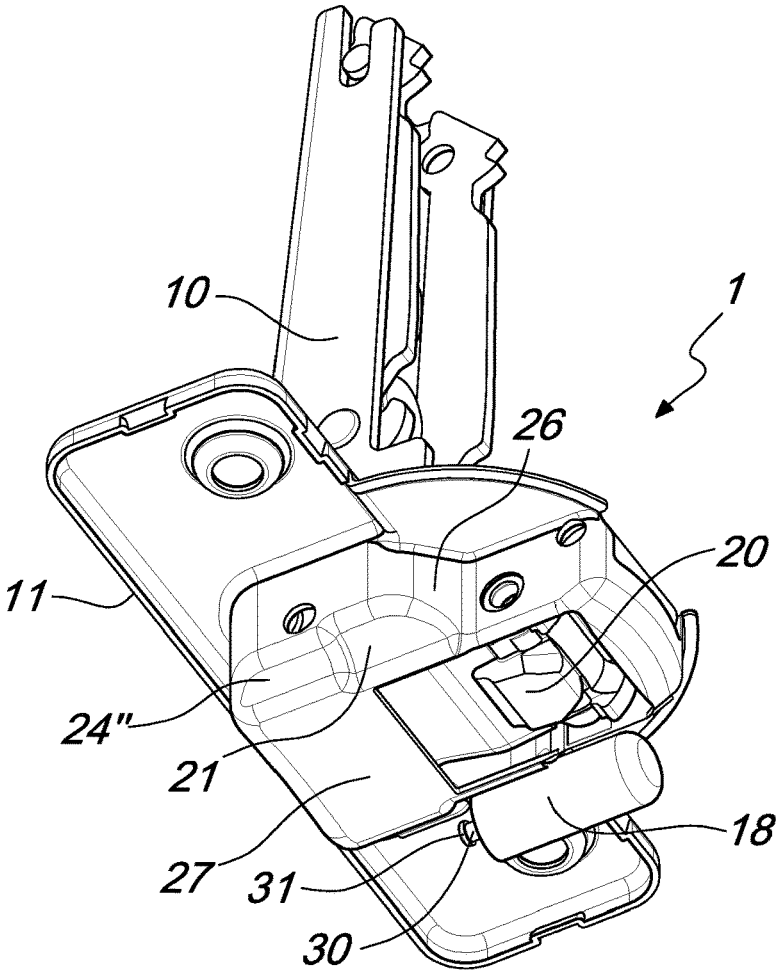
FIG. 4 is a further perspective view of the hinge according to the invention, closed.
Figure 5:
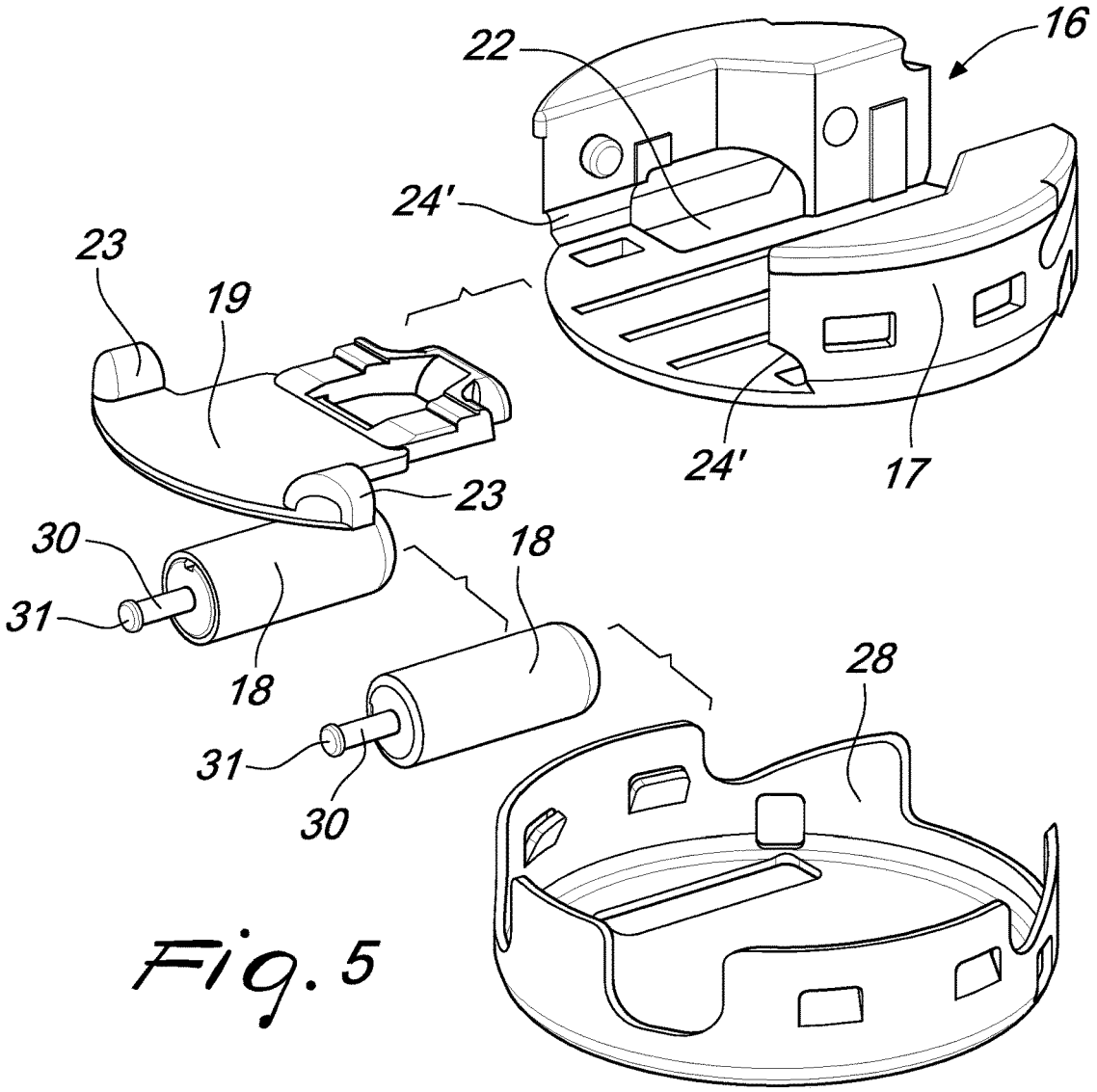
FIG. 5 is an exploded view of the deceleration device.
Figure 6:
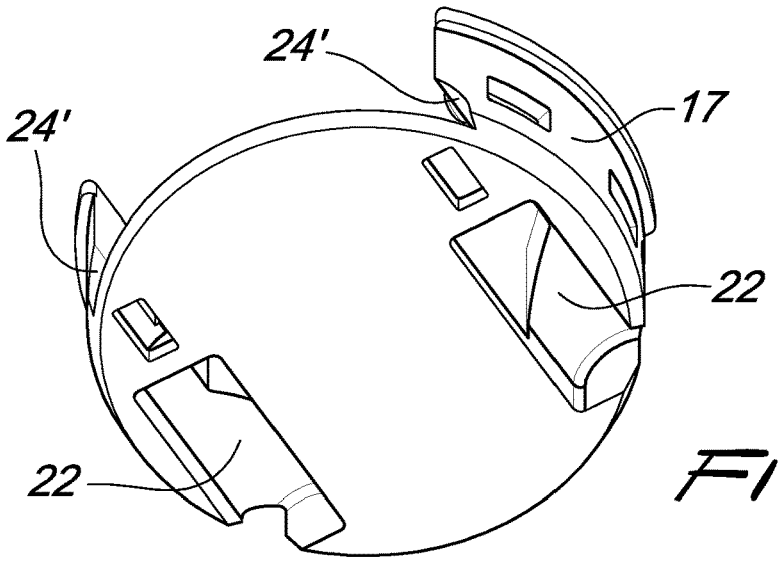
FIG. 6 is a perspective view from below of the body of the decelerator.
Figure 7:
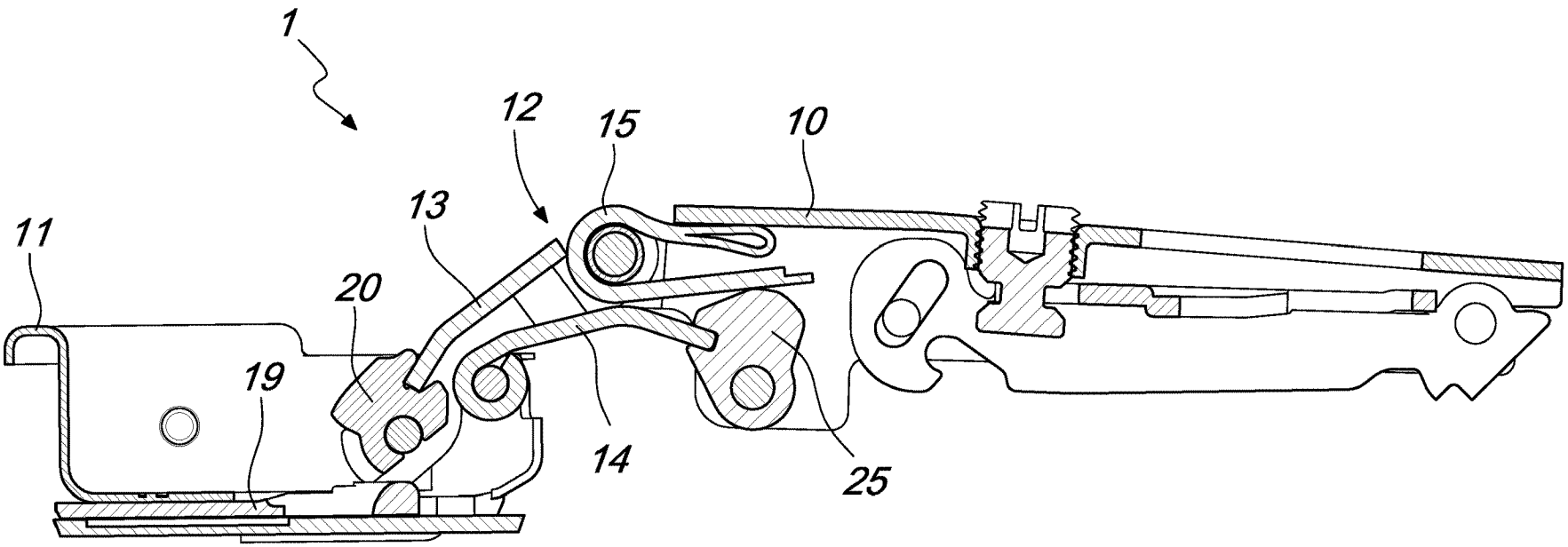
FIG. 7 is a cross-sectional side view of the hinge according to the invention.

With reference to the figures, the hinge according to the invention, generally designated by the reference numeral 1, comprises a fixed part or hinge arm 10 which can be fixed to a fixed part of the piece of furniture, and a moveable part or hinge box 11, which can be fixed to a door leaf of the piece of furniture and connected so that it can oscillate to the hinge arm 10 by way of at least one oscillation pin or a system of articulation 12 which comprises a first oscillating rocker 13 and a second oscillating rocker 14 for connection, in order to be movable between an open position and a closed position of the hinge.

The hinge is further provided with elastic closing means, for example in the form of a leaf spring 15 with a V-shaped cross-section which can be pushed by a cam 25 which is integral with one of the rockers 14.

The hinge further comprises a deceleration device 16 for decelerating a relative movement between the hinge arm 10 and the hinge box 11, which is arranged on the outer side of the side walls 26 and of the bottom 27 of the hinge box 11 and comprises an accommodation body 17 which accommodates fluid-operated means of deceleration which comprise at least one fluid-operated linear decelerator 18.

The fluid-based linear decelerator is conveniently for example an oil-operated cylinder in which there is a moveable piston connected to a rod that juts out from the cylinder.

Preferentially there are two linear decelerators 18 arranged at rear longitudinal edges of the hinge box 11.

There are also actuation means for actuating the deceleration device 16, which can be actuated by the oscillating motion of the hinge arm 10 or of one of the connecting rockers 13 and 14. In particular, the actuation means of the deceleration device comprise a sliding element 19 interposed between the accommodation body 17 and the bottom wall of the hinge box 11, such sliding element 19 functionally connecting the at least one linear decelerator 18 with the hinge arm 10 or with one of the connecting rockers 13 and 14.

The sliding actuation element 19 is shaped and arranged so as to functionally mate automatically with the hinge arm 10 or with one of the connecting rockers 13 and 14, or with a command cam 20 which is integral therewith, in the condition of the deceleration device 16 being assembled with the hinge box 11.

The deceleration device 16 is preferably in the form of an assembly that can be assembled separately and can be fixed to the hinge box 11.

The hinge box 11 is preferably provided with at least one retention seat 21 for the at least one linear decelerator 18, such seat 21 cooperating with an accommodation seat 22 of the body 17 of the deceleration device 16 in order to retain the linear decelerator 18.

Conveniently, the accommodation seat 22 of the body 17 is provided as a recess defined on the bottom surface of the body 17.

The sliding actuation element 19 is provided with guiding means 23 which are configured as protrusions defined at one end of the element 19 and which can slide in guiding seats 24', 24" which are defined respectively in the accommodation body 17 and at rear edges of the hinge box 11.

The linear decelerator 18 is functionally connected to the hinge arm 10 or to one of the connecting rockers 13 and 14 during at least one portion of the oscillating motion of the hinge arm 10 close to the closed position of the hinge, and the functional connection can be bidirectional or unidirectional.

In particular, for a bidirectional connection, the linear decelerator 18 is connected functionally to the hinge arm 10 or to one of the connecting rockers 13 and 14 both during the movement in the direction of the closed position of the hinge, and during the movement in the direction of the open position of the hinge.

By contrast, for a unidirectional connection, the above functional connection occurs only during the movement in the direction of the closed position of the hinge, while for rearming the deceleration device 16 elastic means of rearming the device are arranged within the at least one linear decelerator or are in any case functionally connected to a moveable element of the device.

The linear decelerator 18 comprises a cylinder that can be in the form of a separate element arranged in a corresponding seat 22 of the accommodation body 17 or it can be defined directly in the accommodation body 17 of the deceleration device.

As a further alternative, the cylinder can be defined in a single body with the sliding element 19, and in this case a stem 30 engages in a seat of the accommodation body 17 of the deceleration device.

Each linear decelerator 18 comprises a stem 30 which ends with an end portion 31 which engages with a respective seat of the sliding element 19, for example below guiding means 23 for guiding the sliding element 19.

In this manner, the deceleration device can be assembled externally to the box 11 by arranging the sliding actuation element 19 beyond the at least one linear decelerator 18 and the body 17 of the deceleration device 16.

The deceleration device is then optionally completed by a covering element 28 which is adapted to be arranged to cover the accommodation body 17.

Therefore, the assembly of the deceleration device can be carried out separately from the hinge and the deceleration device can then be applied to the hinge box. The number of components of the deceleration device is low and the assembly is simplified.

In practice it has been found that the decelerated hinge according to the present invention fully achieves the set aim and objects, in that it makes it possible to obtain a deceleration with a deceleration device that is simple, reliable and compact, and above all can be assembled separately from the hinge proper.

The hinge, thus conceived, is susceptible of numerous modifications and variations, all of which are within the scope of the appended claims.

Moreover, all the details may be substituted by other, technically equivalent elements.

In practice the materials employed, and the contingent dimensions and shapes, may be any according to requirements and to the state of the art.

The disclosures in Italian Patent Application No. MI2014A002226 (102014902318857) from which this application claims priority are incorporated herein by reference.

The invention claimed is:

1. A decelerated hinge for furniture, comprising:

a fixed part attachable to a body of the furniture;

a moveable part attachable to a leaf of the furniture, the moveable part comprising a box with side walls and a bottom, said movable part configured to oscillate about the fixed part by way of a system of articulation, wherein the system of articulation comprises a first oscillating rocker and a second oscillating rocker, a deceleration device which comprises: at least one linear decelerator and a sliding element for said linear decelerator, said sliding element engaging one of said fixed part, said first oscillating rocker or said second oscillating rocker, wherein said sliding element comprises at least one seat, and wherein said at least one linear decelerator comprises a stem, wherein said stem comprises a first end and a second end, wherein said first end contacts and extends from said at least one linear decelerator, and wherein said second end is configured to contact said at least one seat, an accommodation body housing said at least one linear decelerator and said sliding element, said accommodation body configured to couple externally to the side walls and the bottom of said box, wherein the sliding element is arranged between the accommodation body and the bottom of the hinge box, wherein the sliding element is provided with protrusions defined at one end of the sliding element the protrusions are configured to slide in guiding seats, the guiding seats being defined respectively in the accommodation body.

2. The decelerated hinge according to claim 1, wherein said at least one linear decelerator is accommodated in a retention seat, which is defined in said box, and cooperates with an accommodation seat, which is defined in said accommodation body, wherein the accommodation seat retains the at least one linear decelerator.

3. The hinge according to claim 2, wherein said retention seat is defined by a recess provided on an outer rear side of the box.

4. The hinge according to claim 1, wherein said at least one linear decelerator is arranged at a respective rear longitudinal edge of the box.

5. The hinge according to claim 1, wherein said seat is adapted to slide in guiding seats of said accommodation body.

6. The hinge according to claim 5, wherein said guiding seats are defined in the accommodation body.

7. The hinge according to claim 2, wherein said at least one linear decelerator comprises a cylinder that is in said accommodation seat of the accommodation body.

8. The hinge according to claim 2, wherein said at least one linear decelerator comprises a cylinder that is defined in said accommodation body of the deceleration device.

9. The hinge according to claim 5, wherein said at least one linear decelerator comprises a cylinder that is defined integrally with said sliding element.

10. The hinge according to claim 2, wherein said at least one linear decelerator is a fluid type linear decelerator, wherein the fluid type linear decelerator is an oil-operated cylinder in which there is a moveable piston connected to a rod that extends from the cylinder.

11. The hinge according to claim 5, wherein said fixed part of the hinge comprises an arm, said rockers being further provided for connection between said arm and said box, said at least one linear decelerator transmitting a deceleration force to one of said connecting rockers, during at least one portion of the oscillating motion of said arm close to the closed position of the hinge.

12. The hinge according to claim 11, wherein said sliding element is shaped so as to mate with said arm or with one of said connecting rockers, or with a command cam which is integral with said connecting rockers.

13. The hinge according to claim 11, wherein said linear decelerator transmits said deceleration force one of said connecting rockers.

14. A decelerated hinge for furniture, comprising:

a fixed part attachable to a body of the furniture;

a moveable part attachable to a leaf of the furniture, the moveable part comprising a box with side walls and a bottom, said movable part configured to oscillate about the fixed part by way of a system of articulation, wherein the system of articulation comprises a first oscillating rocker and a second oscillating rocker, a deceleration device which comprises: at least one linear decelerator and a sliding element for said linear decelerator, said sliding element engaging one of said fixed part, said first oscillating rocker or said second oscillating rocker, wherein said sliding element comprises at least one seat defined below at least one protrusion, and wherein said at least one linear decelerator comprises a stem, wherein said stem comprises a first end and a second end, wherein said first end contacts and extends from said at least one linear decelerator, and wherein said second end is configured to contact said at least one seat, the at least one seat comprising an opening in a bottom surface of the sliding element, an accommodation body housing said at least one linear decelerator and said sliding element, said accommodation body configured to couple externally to the side walls and the bottom of said box, wherein the sliding element is arranged between the accommodation body and the bottom of the hinge box.

15. A decelerated hinge for furniture, comprising:

a fixed part attachable to a body of the furniture;

a moveable part attachable to a leaf of the furniture, the moveable part comprising a box with side walls and a bottom, said movable part configured to oscillate about the fixed part by way of a system of articulation, wherein the system of articulation comprises a first oscillating rocker and a second oscillating rocker, a deceleration device which comprises: at least one linear decelerator and a sliding element for said linear decelerator, said sliding element engaging one of said fixed part, said first oscillating rocker or said second oscillating rocker, wherein said sliding element comprises at least one seat, and wherein said at least one linear decelerator comprises a stem, wherein said stem comprises a first end and a second end, wherein said first end contacts and extends from said at least one linear decelerator, and wherein said second end is configured to contact said at least one seat, an accommodation body housing said at least one linear decelerator and said sliding element, said accommodation body configured to couple externally to the side walls and the bottom of said box, wherein the sliding element is arranged between the accommodation body and the bottom of the hinge box, wherein said at least one linear decelerator comprises two linear decelerators, the two linear decelerators are accommodated in two retention seats, the retention seats cooperate with two accommodation seats of the accommodation body of the deceleration device in order to retain the at least one linear decelerator, the accommodation seats are on opposite sides of the accommodation body, and are each offset from a central axis of the sliding element.

16. A decelerated hinge for furniture, comprising:

a fixed part attachable to a body of the furniture;

a moveable part attachable to a leaf of the furniture, the moveable part comprising a box with side walls and a bottom, said movable part configured to oscillate about the fixed part by way of a system of articulation, wherein the system of articulation comprises a first oscillating rocker and a second oscillating rocker, a deceleration device which comprises: at least one linear decelerator and a sliding element for said linear decelerator, said sliding element engaging one of said fixed part, said first oscillating rocker or said second oscillating rocker, wherein said sliding element comprises at least one seat, and wherein said at least one linear decelerator comprises a stem, wherein said stem comprises a first end and a second end, wherein said first end contacts and extends from said at least one linear decelerator, and wherein said second end is configured to contact said at least one seat, wherein the at least one linear decelerator comprises two linear decelerators, the two linear decelerators both arranged opposite a central axis of the sliding element, each of the two linear decelerators comprise a stem that extends linearly from each of the two linear decelerators and does not enter the moveable part;

an accommodation body housing said at least one linear decelerator and said sliding element, said accommodation body configured to couple externally to the side walls and the bottom of said box, wherein the sliding element is arranged between the accommodation body and the bottom of the hinge box.

* * * * *